United States Patent [19]

Jones

[11] 4,195,331

[45] Mar. 25, 1980

[54] LAMP CHANGING MODULE

[75] Inventor: Eric. M. Jones, Los Angeles, Calif.

[73] Assignee: Karl Storz Endoscopy-America, Inc., Los Angeles, Calif.

[21] Appl. No.: 865,940

[22] Filed: Dec. 30, 1977

[51] Int. Cl.[2] ..... F21V 25/12; H01J 5/02; H01J 5/12; H01J 5/14; H01J 5/48

[52] U.S. Cl. ..... 362/368; 313/17; 313/25; 313/46; 313/48; 313/242; 313/312; 313/317; 313/318; 339/2 R; 339/2 L; 339/36; 339/39; 339/41; 339/75 R; 339/76; 339/82; 339/89 R; 339/91 R; 339/110 R; 362/226; 362/263; 362/264; 362/267; 362/294; 362/374; 362/375; 362/376; 362/457; 362/804

[58] Field of Search ..... 362/263, 264, 265, 226, 362/362, 457, 158, 164, 165, 232, 223, 294, 267, 374, 375, 368, 376, 804; 313/17, 25, 46, 48, 312, 317, 318, 242; 339/2 R, 2 L, 36, 39, 41, 75 R, 82, 76, 89 R, 91 R, 110 R

[56] References Cited

U.S. PATENT DOCUMENTS

| | | | |
|---|---|---|---|
| 1,981,375 | 11/1934 | Snyder | 362/362 |
| 2,783,365 | 2/1957 | Wilfert | 362/265 |
| 2,963,603 | 12/1960 | Germer | 362/263 |
| 3,317,723 | 5/1967 | Reinhardt | 362/457 |
| 3,358,167 | 12/1967 | Shanks | 362/263 |
| 3,426,234 | 2/1969 | Hayasaka | 362/263 |
| 4,069,415 | 11/1978 | Dacal | 362/362 |

FOREIGN PATENT DOCUMENTS

| | | | |
|---|---|---|---|
| 168001 | 4/1951 | Austria | 362/457 |
| 159230 | 12/1963 | U.S.S.R. | 362/457 |

*Primary Examiner*—Teddy S. Gron
*Attorney, Agent, or Firm*—Donald D. Mon

[57] ABSTRACT

A lamp changing module for totally enclosing a lamp when the module is withdrawn from a support such as an illuminator cabinet, and permitting exposure of the lamp when properly installed and connected to the support. A potentially explosive lamp is thereby contained within the module when it is removed so that even if it explodes it will not harm nearby personnel. It also protects personnel from burn hazards associated with lamp changing.

22 Claims, 8 Drawing Figures

LAMP CHANGING MODULE

This invention relates to a lamp changing module which totally encloses a potentially explosive lamp when the module is withdrawn from support means, and which exposes the lamp when it is properly installed in a support means.

Especially in the field of surgical illuminators, high-intensitylamps are utilized which have substantial internal pressures. For example a Xenon short arc lamp with a substantial pressure in a frangible envelope. Should the envelope fracture, shards will be propelled. As with any other lamp, these lamps can finally burn out and must be replaced. The replacement of these lamps requires handling, and it is better that this be done elsewhere than in the surgical operating theatre, and that it be done by skilled personnel. Accordingly, it is an objective of this invention to provide a lamp changing module which will permit the lamp to be exposed to direct visual observation so that it can illuminate an area when it is mounted to a support means such as a cabinet, usually within the cabinet. Then, even if the lamp explodes, nearby personnel are protected by the support means. It also protects personnel from burn hazards associated with lamp changing.

It is another object of this invention to provide such a module which cannot be removed from this safe environment unless a closure operation occurs which will shield the lamp from direct visual observation, which means that shards cannot escape from the lamp after the module is released from the support means, and also that a hot lamp canot be touched.

A lamp changing module according to this invention is provided for totally enclosing a lamp when the module is withdrawn from a complementary socket and support means, and which permits exposure of the lamp when it is connected to the complementary socket and support means. The module includes an internal sheath which has an axis and a window facing the axis. This window has a peripheral extent not greater than 180°. Lamp mounting means is non-rotatably secured to the sheath, and is connected thereto for axial movement therewith. The lamp mounting means is adapted to support a lamp so that its beam is directed toward the window in the sheath. Electrical connection means is carried by the lamp mounting means for making electrical connection with the lamp.

A tubular cover surrounds the sheath. It has an axis, and an aperture facing toward the axis. The cover is mounted to the sheath for rotation relative thereto, their axes being coincident or parallel. The window and aperture are so disposed and arranged that in a first relative angular position of the sheath and cover they are aligned to give direct visual access to the lamp, and in a second relative angular position they are not aligned, so as to prevent direct visual access to the lamp.

Key means is provided having a first portion attachable to said support means and a second portion carried by the module, said key means preventing removal of the module from the first portion when in the first relative angular position and enabling their separation when in the second relative angular position.

According to a preferred but optional feature of the invention, latch means is interposed between the sheath and the cover, and latch release means is attachable to the support means. The latch means when latched restrains the sheath and the cover in the second relative angular position, the latch release means releasing the latch means and enabling relative rotation of the sheath and cover only when said module is properly mounted to said support structure.

According to still another preferred but optional feature of the invention, one of the portions of the key means is a ring including a shoulder, the shoulder having a notch and in which the said second portion of the key means comprises a stud which can pass through the notch in the said second relative angular position, and interferes with the shoulder in the first relative angular position, whereby to enable separation of the module from the first portion while in the second relative angular position and to prevent the separation while in said first relative angular position.

The above and other features of this invention will be fully understood from the following detailed description and the accompanying drawings, in which.

Figures 1, 2, 7, 8:
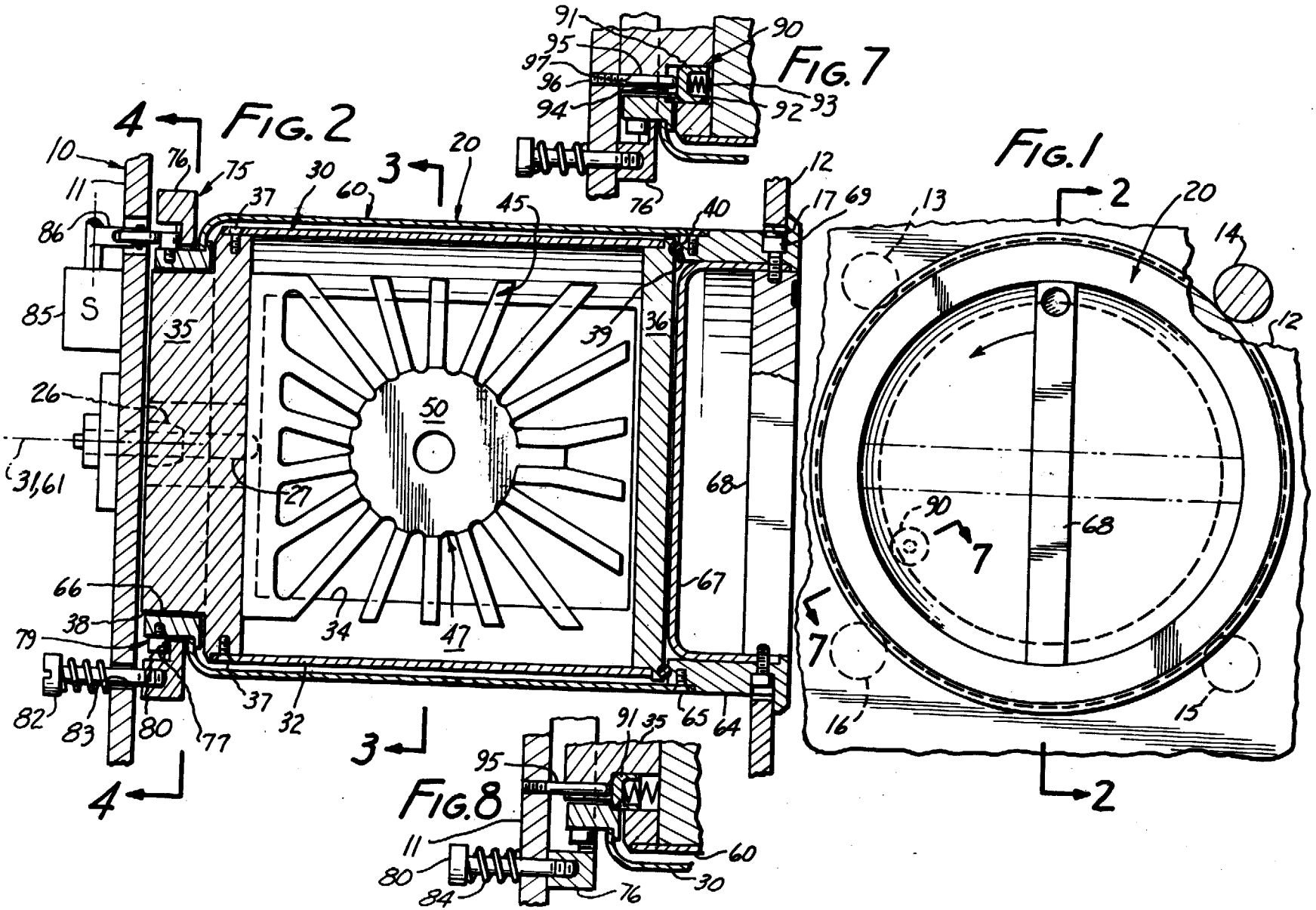
FIG. 1 is a top view of the presently preferred embodiment of the invention.
FIG. 2 is an axial cross-section taken at line 2—2 in FIG. 1.
Figure 3:
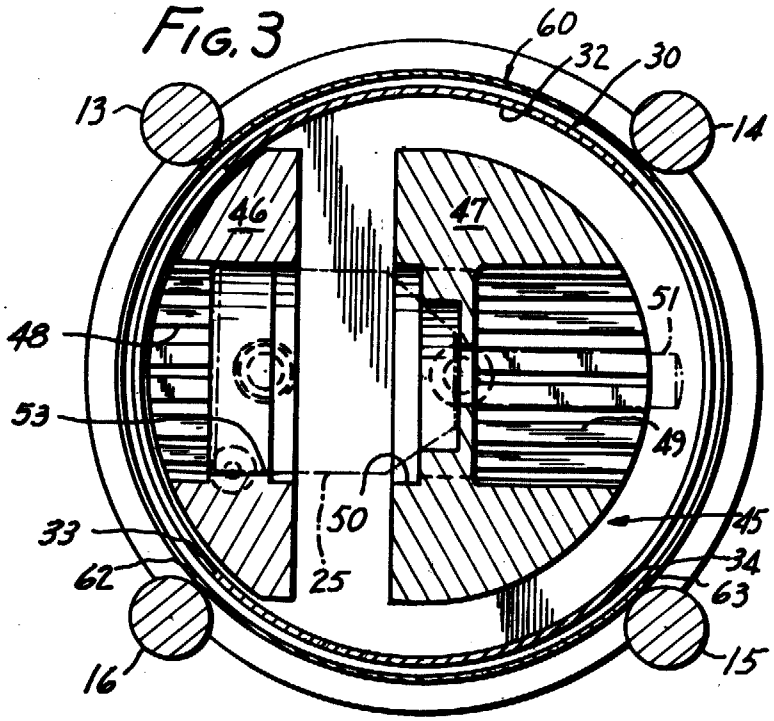
Figure 6:
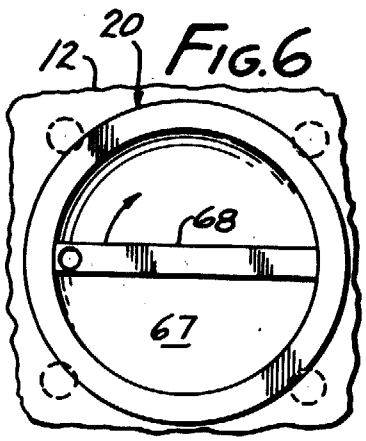
Figure 4:
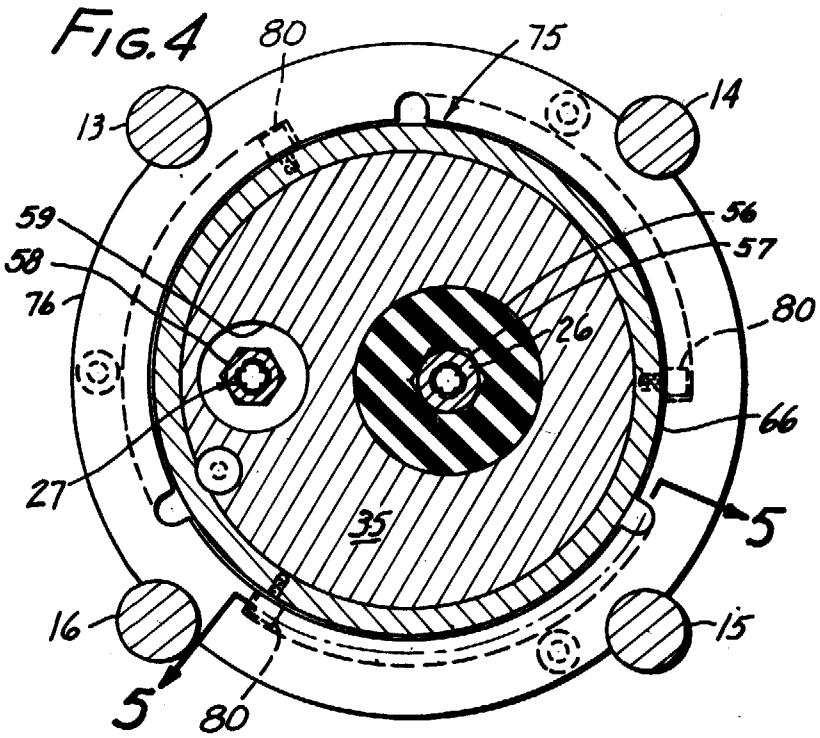
Figure 5:
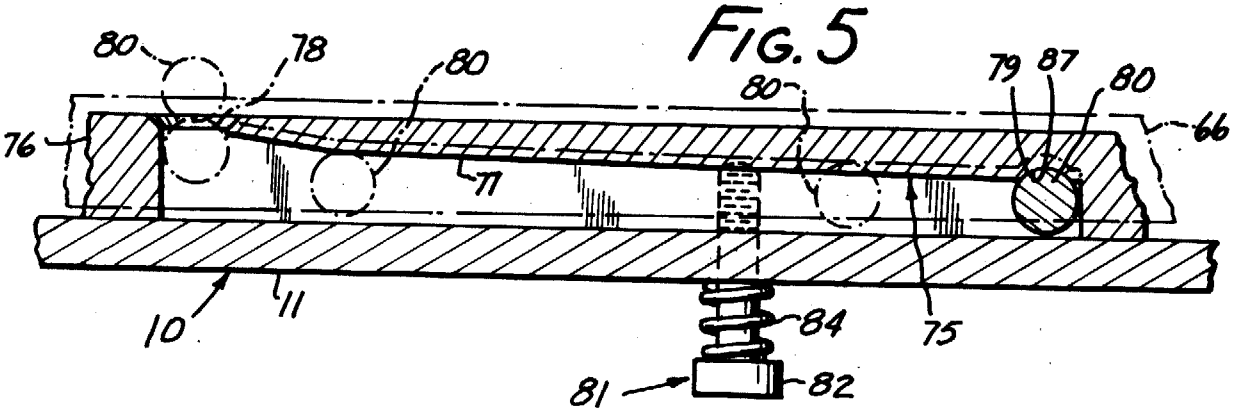

FIGS. 3 and 4 are cross-sections taken at lines 3—3 and 4—4, respectively, in FIG. 2;

FIG. 5 is a section taken at section line 5—5 in FIG. 4;

FIG. 6 is a top view similar to FIG. 1 with the module in another position;

FIG. 7 is a fragmentary cross-section taken at line 7—7 in FIG. 1 and showing a circumstance which occurs when the module is in the condition illustrated in FIGS. 1—5 inclusive, i.e., a ("first relative angular position"); and FIG. 8 is a view similar to FIG. 7 showing the condition which occurs when the module is in a "second relative angular position " shown in FIG. 6.

The presently preferred embodiment of the invention, which is also the best known mode of accomplishing the same, is shown in FIGS. 1–8. With initial reference to FIGS. 1 and 2, there is shown a support means 10 which in the usual situation will comprise an illuminator cabinet, of which only the base 11 and the top 12 are shown. They are connected by a group of interconnecting bolts 13, 14, 15, and 16 which can also serve as guide rails for the module. In the complete support means, there will also be a peripheral wall which surrounds the enclosed items. It extends from the base to the top and will have apertures for various purposes. It will serve to protect personnel should the installed lamp explode, an extremely rare event. Because the base and the top are the only portions of specific importance to this invention, the remainder of the structure will not be disclosed or illustrated in detail.

The top has an opening 17 through which lamp changing module 20 is inserted. The base includes connectors 26, 27 in the shape of prongs. These are connected to circuitry providing current to illuminate a lamp 25.

The purpose of this module is to protect personnel from the dangers of explosion of lamp 25, and also from burn hazards associated with lamp changing. This can be any type of lamp, but unless the lamp encloses gas under substantial pressure there is little need for this invention. The lamps which are likeliest to be used are those which provide very high intensity from small bulbs such as Xenon arc lamps under substantial internal pressure. Should such a lamp explode in the hands of the user without protection, then there is danger of injury. Such injury is likeliest to occur when changing the lamp.

The lamp itself is adapted to be connected to circuitry for supplying current to it. The lamp is shown in phantom line in order not obscure the disclosure of structure (FIG. 3). Current applied to the lamp will cause it to emit light to the left in FIG. 3.

The module includes an internal sheath 30 with an axis 31 and a peripheral wall 32. The peripheral wall has a pair of windows 33, 34 therethrough whose peripheral angular extent totals no more than 180°. The peripheral wall is preferably formed as a cylinder and is mounted to end pieces 35 and 36. Is held to end piece 35 by screws 37, and to end piece 36 by means such as a press-fit or cementing. End piece 35 has a neck 38 with a circular section which accommodates a socket and prong means yet to be described.

End piece 36 includes a ring groove 39 which receives an O-ring 40. This ring acts as a thrust bearing. Lamp mounting means 45 is fixed to, or if preferred can be made integral with, end piece 35. It comprises a pair of arms 46, 47 with heat transfer means 48, 49, for example fins, which can be exposed to a stream of cooling fluid such as air driven by a fan. Arm 47 has a receptacle 50 to receive the base 51 of lamp 25. Arm 46 has a passage 53 which enbraces the wall of the lamp so that the lamp is in heat conductive contact with the lamp mounting means and is also supported thereby. It will be observed that the lamp is intended to emit its light to the left in FIG. 3 through window 33. Window 34 is provided principally for air flow.

Electrical connection means 55 is provided for connecting the lamp to other circuitries. As can best be seen in FIG. 4, an insulator 56 surrounds a conductor 57 which conductor can be connected to the lamp by any suitable electrical conductor (not shown). Conductor 58 projects through a passage 59 in the lamp conductors 57 and 58, and is connected by a suitable electrical conductor (not shown) to the other connector on the lamp. Whatever the arrangement, both of these conductors 57 and 58 comprise a socket which receive the prongs 26 and 27 when the module is connected to the support means. It will be noted that these prongs are asymmetrically disposed relative to the axis, and there is therefore a single unique orientation of the module relative to the support means in which it can be installed. It is equally evident that this installation is made by an axial plug-in movement along the axis of the module.

The module also includes a tubular cover 60 which has an axis 61 that is co-axial with axis 31 of the sheath. It includes a pair of apertures 62, 63 through its wall. These apertures leave a wall which has a total of at least 180° subtense so that it can occlude the windows. In the first relative angular position of the sheath and the cover, the windows of apertures are aligned to give direct visual access to the lamp. This is the situaion when the module is installed and ready to use. In a second relative angular position, the tubular cover will have been rotated a sufficient number of degrees such that the apertures do not overlap the window (FIG. 6), and there is not a direct visual access to the lamp. An exploding lamp will propel its shards along the paths of direct visible access. Therefore, if there is no direct visible access, then it can be expected that there will not be a risk of freely flying shards in the event the lamp explodes. Accordingly it is not necessary that the sheath and the cover be particularly close together radially, but only that there be no path where the shards can fly directly out of the module. The first relative angular position is shown in FIG. 3.

The tubular cover includes a collar 64 to which it is attached by screws 65. It also includes a base ring 66 to which the central part of the tubular cover is rigidly attached, perhaps by spot welding or by cementing.

A cup 67 and a handle 68 are attached to the collar by screws 69. The tubular cover can be rotated by gripping the handle and turning it. It will be seen that the collar, the central section, and the base ring, are held together in sucha way that the entire module can be axially pulled and pushed by the handle.

Key means 75 includes a first portion 76 attachable to the base 11. This first portion is a ring which includes a shoulder 77 having a notch 78 (actually there is a plurality of shoulders and notches). The shoulder faces toward the support means. The key means includes a second portion 79 in the form of a threaded stud 80 projecting radially outwardly from the outer wall of the base ring 66. Its dimensions are such that it can pass axially through notch 78 when radially aligned therewith, and when the tubular cover is turned relative to the plugged in sheath, can move along the underside of the shoulder in "interference" therewith. By "interference" is meant the arrangement that the module cannot be pulled free of the ring unless the stud is aligned with the notch.

A floating mount is desirable for the key means and this is provided by attachment means 81 which comprises a plurality of headed bolts 82 passed with a clearance through holes 83 in the base 11, with a spring 84 biasing the head away from the base, and thereby pulling the first portion 76 toward the support means i.e., toward the bottom 11. When the stud and the shoulder interfere with one another, the effect of the bias is to bias the entire lamp module toward the support means and thereby assure the integrity of any plug-in electrical connection.

Switch means 85 is mounted to the base, and includes a follower arm 86 whose position is determined by the position of the stud. When the stud is in the position as shown in FIG. 2 the follower arm is in a position which in this device will set the switch to enable conduction of electricity to the lamp, or to auxiliary equipment such as a fan. When the cover is turned so that the stud does not depress the follower arm, then the switch is set to an open position to disable the circuitry connected to it.

Shoulder 77 is preferably formed as a ramp as best shown in FIG. 5 so that, as the tubular cover is rotated the assembly is gradually pulled toward the support means. A detent 87 is formed in the shoulder to receive stud 80 and thus to determine and stabilize the end point of the action. Latch means 90 (see FIGS. 7 and 8) is provided to prevent relative rotation of the sheath and cover when the module is not installed on the support means. This prevents opening of the window by turning the cover relative to the sheath unless a specific unlatching operation is accomplished. Routine personnel will not be provided with means to unlatch it. Therefore the lamp is kept inside the closed structure until authorized personnel unlatch it. It can, of course be opened by installing the module.

The latch means comprises a latch member 91 (FIGS. 7 and 8) which is slideable in a bore in end piece 35. A bias spring 93 biases the latch member to the left in FIGS. 7 and 8. A latch face 94 is formed in base ring 66 of the tubular cover. In the position of FIG. 8, the latch member interlocks the sheath and the cover latch release means 95 in the form of a pin 96 is fixed to the base 11. It is adapted to project through hole 97 in end piece 35 when the module is attached to the support means. As can best be seen in FIG. 7, when the module is brought against the base, the pin 96 will have projected through hole 97 and boosted the latch member 91 off of latch face 94 so that the cover can be turned relative to the sheath. However, when the module is not fully installed and carried freely away from the support means, the situation will be as illustrated in FIG. 8 where the pin 96 will not boost the latch member off of the latch face (when the module is removed from the support means, there is no pin at all). The tubular cover and the sheath cannot then be rotated relative to one another. This means that after the module has been removed from the support means, or unless it is fully installed thereon, the sheath and tubular cover will be in the said second relative axial position where there is no direct visual access to the lamp. Direct visual access to the lamp can only be obtained after the module is fully pressed on to unlatch it as shown in FIG. 7 and then rotated.

The operation of this device should be evident from the foregoing. With the module containing a workable lamp, it is simply plugged into the complementary electrically conducting means. Because of asymmetrically alignment of the prongs, this will assure that the studs will pass through the notches. The latch means will be unlatched by this means and then the handle will be turned to rotate the device so that the stud will pass under the ring. The ring will also tend to pull the module toward the base. When the cover is rotated, the windows and apertures begin to overlap one another, and this opens the window such that there is visual access to the lamp. Once the end of the rotation is reached, the stud will fit into the detent 87 and will tend to remain there until it is reversed. It will be understood that the bias on the retainer means can be overcome by a strong enough twist on the handle.

When the lamp needs servicing, the rotation is simply reversed, the window will be closed, the latch will become latched, and the module can be unplugged and carried elsewhere for servicing. It is presumed that the service man will have a pin equivalent to pin 96 so he can unlatch and service the device. Also, because the lamp is carried in a closed module, the customers fingers cannot touch and cloud the optics or the lamp surface.

The importance of this invention is that servicing of the lamp is infeasible in the operating room and it is merely necessary to provide a reserve module quickly to replace a burned out or dim lamp. The lamp and module can be changed by trained personnel in the hospital or elsewhere who will know the best means to accomplish this objective.

The sheath and the tubular cover are made strong enough to resist any flying shards. It is useful to have some clearance between them so as to provide for release of the gas pressure between their margins thereby minimizing damage to the module in the event of explosion of the lamps. Also, burn hazards are eliminated because unskilled persons cannot touch the hot lamp.

This invention is not to be limited by the embodiment shown in the drawings and described in the description which is given by way of example and not of limitation, but only in accordance with the scope of the appended claims.

I claim:

1. A lamp changing module for totally enclosing and assuring the total enclosure of a lamp at the time when the module is withdrawn from a support means, and permitting exposure of the lamp when it is connected to said support means, said module comprising:

an internal sheath having an axis and a window facing said axis, said window having a peripheral extent not greater than 180°;

lamp mounting means non-rotatably secured to said sheath, and connected thereto for axial movement therewith, said lamp mounting means being adapted to support a lamp so it emits light toward said window;

electrical connection means carried by said lamp mounting means adapted to make electrical connection with the lamp;

a tubular cover surrounding said sheath having an axis and an aperture facing said axis, said cover being mounted to said sheath for rotation relative thereto, said axes being coincident or parallel, and said window and aperture being so disposed and arranged that in a first relative angular position of the sheath and cover they are aligned to give direct visual access to the lamp, and in a second relative angular position they are non-aligned so as to prevent direct visual access to the lamp; and key means having a first portion attachable to said support means and a second portion carried by the module, said key means preventing removal of the module from the support means when the sheath and the cover are in said first relative angular position, and enabling removal of the module from the support means when the sheath and the cover are in said second relative angular position.

2. A lamp changing module according to claim 1 in which releasable latch means is interposed between said sheath and said cover, and in which latch release means is attachable to said support means, said latch means when latched restraining said sheath and cover in said second relative angular position, said latch release means releasing said latch means and enabling relative rotation of said sheath and cover only when said module is mounted to said support structure.

3. A lamp changing module according to claim 1 in which one of said portions of said key means is a ring including a shoulder, said shoulder having a notch, and in which said second portion of the key means comprises a stud which can pass through said notch in said second relative angular position, and interferes with the shoulder in said first relative angular position, whereby to enable separation of the module from the support means while the sheath and the cover are in the second relative angular position, and to prevent said separation while the sheath and the cover are in said first relative angular position.

4. A lamp changing module according to claim 3 in which said ring includes spring-biased attachment means biasing said ring toward said support means, said shoulder facing said support means, whereby the stud is drawn toward the support means and draws the module with it to bias it against the support means.

5. A lamp changing module according to claim 1 in which the electrical connection means comprises a pair of asymmetrically arranged structural connectors, whereby uniquely to define an angular positional relationship between the module and the support means.

6. A lamp changing module according to claim 4 in which the electrical connection means comprises a pair of asymmetrically arranged structural connectors, whereby uniquely to define an angular positional relationship between the module and the support means.

7. A lamp changing module according to claim 4 in which said shoulder is sloped as a ramp.

8. A lamp changing module according to claim 7 in which said shoulder includes a detent in which the stud tends to be retained when the module is attached to the support means and the sheath and the cover are in said first relative angular position.

9. A lamp changing module according to claim 1 in which the cover includes a handle for rotating it, and for pushing and pulling on the cover, all relative to said axis, and in which the said cover embraces the sheath, whereby the sheath moves with the cover when pushed or pulled.

10. A lamp changing module according to claim 1 in which switch means is connected to said electrical connection means and is actuated by said key means, whereby to enable flow of current to the lamp when the module is attached to said support means when in said first relative angular position, and to prevent it in said second relative angular position.

11. A lamp changing module according to claim 1 in which the lamp mounting means includes heat transfer surfaces.

12. A lamp changing module according to claim 11 in which said heat transfer surfaces are fins.

13. A lamp changing module according to claim 1 in which said support means carries a pair of prongs, and said lamp mounting means carries a pair of sockets to form part of an electrical circuit to the lamp.

14. A lamp changing module according to claim 3 in which releasable latch means is interposed between said sheath and said cover, and in which latch release means is attachable to said support means, said latch means when latched restraining said sheath and cover in said second relative angular position, said latch release means releasing said latch means and enabling relative rotation of said sheath and cover only when said module is mounted to said support structure.

15. A lamp changing module according to claim 14 in which the cover includes a handle for rotating it, and for pushing and pulling on the cover, all relative to said axis, and in which the said cover embraces the sheath, whereby the sheath moves with the cover when pushed or pulled.

16. An illuminator assembly, comprising in combination:

support means; and a lamp changing module for removable attachment to said support means, said lamp changing module comprising:

an internal sheath having an axis and a window facing from said axis, said window having a peripheral extent not greater than 180°;

lamp mounting means non-rotatably secured to said sheath, and connected thereto for axial movement therewith, said lamp mounting means being adapted to support a lamp so it emits light toward said window;

electrical connection means carried by said lamp mounting means adapted to make electrical connection with the lamp;

a tubular cover surrounding said sheath having an axis and an aperture facing said axis, said cover being mounted to said sheath for rotation relative thereto, said axes being coincident or parallel and said window and aperture being so disposed and arranged that in a first relative angular position of the sheath and cover they are aligned to give direct visual access to the lamp, and in a second relative angular position they are non-aligned so as to prevent direct visual access to the lamp; and key means having a first portion attachable to said support means and a second portion carried by the module, said key means preventing removal of the module from the support means when the sheath and the cover are in said first relative angular position, and enabling removal of the module from the support means only when the sheath and the cover are in said second relative angular position.

17. A lamp changing module according to claim 16 in which the electrical connection means comprises a pair of asymmetrically arranged structural connectors, whereby uniquely to define an angular positional relationship between the module and the support means.

18. A combination according to claim 16 in which latch means is interposed between said sheath and said cover, and in which releasable latch release means is attached to said support means, said latch means when latched restraining said sheath and cover in said second relative angular position, said latch release means releasing said latch means and enabling relative rotation of said sheath and cover to said first relative angular position when said module is mounted to said support structure.

19. A combination according to claim 18 in which one of said portions of the key means is a ring including a shoulder, said shoulder having a notch, and in which said second portion of the key means comprises a stud which can pass through said notch only when the sheath and the cover are in said second relative angular position, and interferes with the shoulder in said first relative angular position, whereby to enable separation of the module from the support means only while the sheath and the cover are in the second relative angular position, and to prevent said separation while the sheath and the cover are in said first relative angular position.

20. A combination according to claim 19 in which said ring includes spring-biased attachment means biasing said ring toward said support means, said shoulder facing said support means, whereby the stud is drawn toward the support means and draws the module with it to bias it against the support means.

21. A combination according to claim 20 in which the cover includes a handle for rotating it, and for pushing and pulling on the cover, all relative to said axis, and in which the said cover embraces the sheath, whereby the sheath moves with the cover when pushed or pulled.

22. A combination according to claim 21 in which the electrical connection means comprises a pair of asymmetrically arranged structural connectors, whereby uniquely to define an angular positional relationship between the module and the support means.

* * * * *